US011325806B2

(12) United States Patent
Hjerpe et al.

(10) Patent No.: US 11,325,806 B2
(45) Date of Patent: May 10, 2022

(54) DROP STITCH TETHERS ALIGNMENT

(71) Applicant: Volvo Car Corporation, Gothenburg (SE)

(72) Inventors: Erik Hjerpe, Torslanda (SE); Nathan Nuzzo, Stockholm (SE)

(73) Assignee: Volvo Car Corporation, Gothenburg (SE)

( * ) Notice: Subject to any disclaimer, the term of this patent is extended or adjusted under 35 U.S.C. 154(b) by 39 days.

(21) Appl. No.: 16/903,423

(22) Filed: Jun. 17, 2020

(65) Prior Publication Data

US 2020/0399091 A1 Dec. 24, 2020

(30) Foreign Application Priority Data

Jun. 20, 2019 (EP) ..... 19181442

(51) Int. Cl.

| | |
|---|---|
| ***B65H 39/16*** | (2006.01) |
| ***B65H 20/12*** | (2006.01) |
| ***B65H 43/00*** | (2006.01) |

(52) U.S. Cl.

CPC ..... *B65H 39/16* (2013.01); *B65H 20/12* (2013.01); *B65H 43/00* (2013.01); *B65H 2701/174* (2013.01); *B65H 2701/1864* (2013.01)

(58) Field of Classification Search

None

See application file for complete search history.

(56) References Cited

U.S. PATENT DOCUMENTS

| | | | |
|---|---|---|---|
| 2009/0078186 | A1 | 3/2009 | Rista |
| 2010/0307629 | A1 | 12/2010 | Citterio |
| 2012/0005836 | A1 | 1/2012 | Cik |

FOREIGN PATENT DOCUMENTS

| | | | | |
|---|---|---|---|---|
| CN | 103132233 | A | | 6/2013 |
| CN | 107548285 | A | | 1/2018 |
| CN | 107700133 | A | | 2/2018 |
| GB | 2265610 | A | | 10/1993 |
| GB | 2409190 | A | | 6/2005 |
| KR | 20100106792 | A | * | 10/2010 |
| WO | 2018170337 | A2 | | 9/2018 |

OTHER PUBLICATIONS

Dec. 16, 2019 European Search Report issued on International Application No. 19181442.

Office Action issued in the corresponding Chinese patent application 2020105689177.

* cited by examiner

*Primary Examiner* — Leslie A Nicholson, III

(74) *Attorney, Agent, or Firm* — Clements Bernard Walker; Christopher L. Bernard

(57) ABSTRACT

The present disclosure relates to a method performed by an alignment system for aligning tethers of a drop stitch fabric prior to feeding the drop stitch fabric to a drop stitch fabric processing machine. The alignment system feeds a drop stitch fabric having a first layer and a second layer tethered by drop stitch tethers, wherein the first layer is moving with a first velocity and the second layer is moving with a second velocity. The disclosure also relates to an alignment system in accordance with to the foregoing.

18 Claims, 4 Drawing Sheets

DROP STITCH TETHERS ALIGNMENT

CROSS-REFERENCE TO RELATED APPLICATION

The present disclosure claims the benefit of priority of co-pending European Patent Application No. 19181442.5, filed on Jun. 20, 2019, and entitled "DROP STITCH TETHERS ALIGNMENT," the contents of which are incorporated in full by reference herein.

TECHNICAL FIELD

The present disclosure relates to aligning tethers of a drop stitch fabric prior to feeding the drop stitch fabric to a drop stitch fabric processing machine.

BACKGROUND

Products based on inflatable drop stitch technology are becoming increasingly popular, not the least since such products—e.g. kayaks, floats, gym mats etc.—when deflated, may be less bulky and hence more easily stored and/or transported, and further, be less heavy and/or less costly, than corresponding products of traditional material. Commonly, an inflatable drop stitch may be e.g. a PVC-coated, TPU-coated and/or laminated nylon and/or polyester fabric with layers joined by a dense array of e.g. vertical linear and/or zigzag fibers and/or polyester strands that are uniform in size. When the inflatable drop stitch then is adapted—e.g. glued and/or welded—into desired shape, and subsequently pressurized with air and/or gas, it may be transformed into a strong, firm structure. The vertical fibers and/or strands—which may be referred to as the drop stitches and/or drop stitch tethers which is a term used herein—hold the air chamber firmly in shape, thus allowing the inflated structure to maintain its shape and stability under heavy outside pressure and impact.

When manufacturing an inflatable drop stitch product, a drop stitch fabric may—among other things—be coated and/or impregnated, a contour of the drop stitch product be cut out from said fabric, edges around the perimeter of the inflatable drop stitch product potentially be sewed together, and/or said edges be welded and/or sealed—e.g. by means of patches—to enable said product to be airtight and/or gas proof. Handling of drop stitch fabric may, however, be troublesome, in that the layers of the drop stitch fabric—which are separated by tethers joining them—may become offset relative one another to an extent maximally being essentially the length of the tethers. During a manufacturing process, accordingly, the layers of the drop stitch fabric may unintentionally be, or become, offset in relation to one another and subsequently the tethers be, or become, misaligned, thus implicating that wrinkles and/or distortions may arise and/or that an intended shape of a potential inflatable product derived from the drop stitch fabric involuntarily may be altered.

SUMMARY

It is therefore an object of embodiments herein to provide an approach that overcomes or ameliorates at least one of the disadvantages of the prior art, or to provide a useful alternative.

The object above may be achieved by the subject matter disclosed herein. Embodiments are set forth in the appended claims, in the following description and in the drawings.

The disclosed subject matter relates to a method performed by an alignment system for aligning tethers of a drop stitch fabric prior to feeding the drop stitch fabric to a drop stitch fabric processing machine. The alignment system feeds a drop stitch fabric having a first layer and a second layer tethered by drop stitch tethers, wherein the first layer is moving with a first velocity and the second layer is moving with a second velocity.

The disclosed subject matter further relates to an alignment system for—and/or adapted for—aligning tethers of a drop stitch fabric prior to feeding the drop stitch fabric to a drop stitch fabric processing machine. The alignment system comprises a velocity controlling unit for controlling feeding a drop stitch fabric having a first layer and a second layer tethered by drop stitch tethers, wherein the first layer is moving with a first velocity and the second layer is moving with a second velocity.

Moreover, the disclosed subject matter relates to a computer program product comprising a computer program containing computer program code means arranged to cause a computer or a processor to execute the steps performed by the alignment system discussed above, stored on a computer-readable medium or a carrier wave.

Thereby, there is introduced an approach which enables a potential displacement between drop stitch layers—and subsequently an inadequate alignment of tethers there between—to be compensated, by feeding—e.g. from a drop stitch fabric supply comprising a drop stitch fabric—the first and second layers with different velocities. That is, when e.g. coming off the drop stitch fabric supply, the first and the second drop stitch layers may—for instance due to the drop stitch fabric having been rolled, wrapped and/or folded—be displaced in relation to one another in a running direction of the drop stitch fabric, and subsequently may the drop stitch tethers be correspondingly inadequately aligned, such as no longer being perpendicular to the layers. This may lead to that issues related to wrinkles and/or distortions as well as an involuntarily altered shape of a potential subsequent inflatable structure derivable from the drop stitch fabric, subsequently may arise. With the introduced concept, however, by feeding—e.g. from the drop stitch fabric supply comprising the drop stitch fabric—the first layer with a first velocity and the second layer with a potentially differing second velocity, a potential displacement between the layers—and subsequently an inadequate alignment of the tethers—may be compensated prior to the drop stitch fabric being fed to the drop stitch fabric processing machine, whereby said issues consequently may be avoided.

The technical features and corresponding advantages will be discussed in further detail in the following.

BRIEF DESCRIPTION OF THE DRAWINGS

The various aspects of the non-limiting embodiments, including particular features and advantages, will be readily understood from the following detailed description and the accompanying drawings, in which.

DESCRIPTION OF EMBODIMENTS

Figure 1:
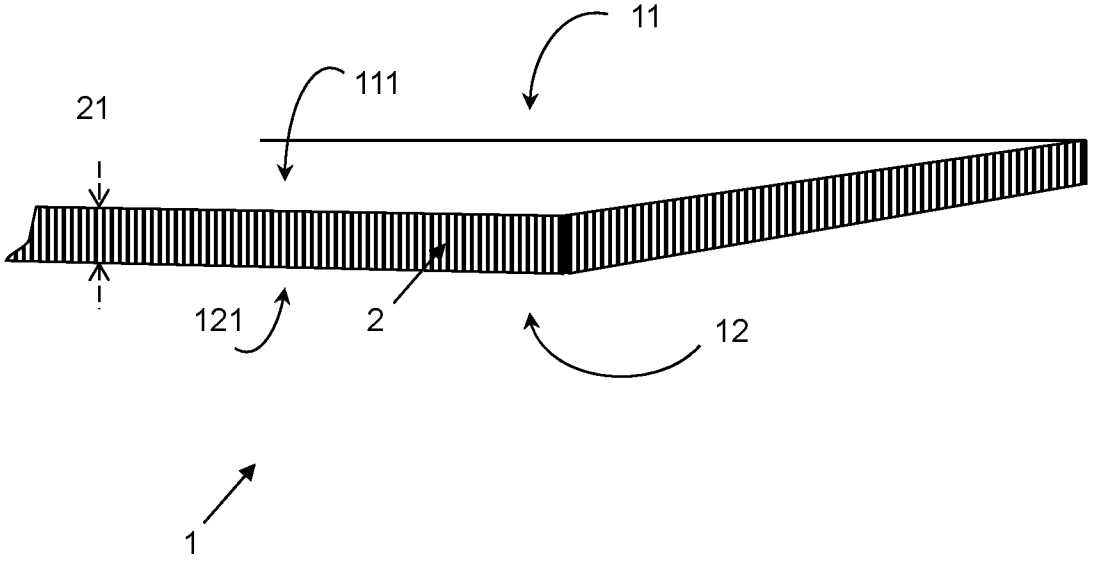
FIG. 1 illustrates a schematic three-dimensional side view of a portion of an exemplifying drop stitch fabric.

Non-limiting embodiments of the present disclosure will now be described more fully hereinafter with reference to the accompanying drawings, in which currently preferred embodiments of the disclosure are shown. This disclosure may, however, be embodied in many different forms and should not be construed as limited to the embodiments set forth herein. Like reference characters refer to like elements throughout. Dashed lines of some boxes in the figures indicate that these units or actions are optional and not mandatory.

In the following, according to embodiments herein which relate to aligning tethers of a drop stitch fabric prior to feeding the drop stitch fabric to a drop stitch fabric processing machine, there will be disclosed an approach which enables a potential displacement between drop stitch layers—and subsequently an inadequate alignment of drop stitch tethers—to be compensated.

Referring now to the figures and FIG. 1 in particular, there is depicted a schematic three-dimensional side view of a portion of an exemplifying drop stitch fabric 1. The drop stitch fabric 1 has a first layer 11 and a second layer 12 tethered by drop stitch tethers 2. The first and second layers have a respective outer surface 111, 121. The drop stitch fabric 1 may refer to any drop stitch fabric commonly known in the art, and be of any dimensions—e.g. width and/or length—deemed suitable, e.g. range from tenths of metres up to hundreds of metres. In a similar manner, the first layer 11 and the second layer 12 may refer to any drop stitch layers commonly known, and be of any thickness deemed suitable e.g. in view of an intended inflatable structure, e.g. range from tenths of millimetres up to several millimetres, and/or comprise any material commonly known, such as for instance nylon and/or polyester. Moreover, the first layer 11 and/or the second layer 12 may each be represented by a respective set of layers lying on top of another in a known manner, which layers may or may not comprise different materials. Yet again, in a similar manner, the drop stitch tethers 2 may be represented by any drop stitches known in the art, e.g. be represented by fibers, strands and/or threads e.g. comprising polyester material and moreover e.g. be provided in a linear, zigzag and/or random pattern. The drop stitch tethers 2 may further be of any dimensions and/or characteristics deemed suitable, e.g. in view of an intended inflatable structure, and for instance may a length of the drop stitch tethers 2, i.e. a tethers length 21, range from a few millimetres up to hundreds of millimetres. The drop stitch tethers 2 may in a commonly known manner extend through the first layer 11 and the second layer 12, and further—should the first 11 and/or the second 12 layer be represented by a respective set of layers—then the drop stitch tethers 2 may extend through one, a few or all of the layers in the respective set. The drop stitch fabric 1, the first layer 11, the second layer 12 and the drop stitch tethers 2 may be—and/or have been—manufactured in any commonly known manner, for instance with support from a—potentially known—drop stitching system and/or machine (not shown), e.g. a weaving, sewing, stitching and/or loom machine and/or system. The expression "drop stitch fabric" may refer to "uniform, integral and/or undivided drop stitch fabric", "drop stitch fabric with a uniform extension area" and/or "two-layer fabric", whereas "fabric" may refer to "material" and/or "cloth". The expression "layer", on the other hand, may refer to "set of parallel layers and/or "essentially and/or at least partly parallel layers", whereas "tethered" by drop stitch tethers may refer to "tethered by a dense array" of drop stitch tethers and further to "coupled", "joined" and/or "held" by drop stitch tethers. "Drop stitch tethers" may refer to "drop stitches", "spacer threads" and/or "vertical stitches", and further to "drop stitch tethers there between".

The drop stitch fabric 1 may potentially be utilized for manufacturing of an inflatable structure (not shown). Such an inflatable structure derivable from the drop stitch fabric 1 may be represented by any inflatable product and/or article deemed feasible and/or applicable, for instance an inflatable kayak, float, gym mat, and/or trampoline etc., and further for instance an inflatable seat, child seat and/or pet cage or the like which e.g. may be carried on-board a vehicle and/or be detachably attached to an interior thereof. Said potential inflatable structure may for instance in a commonly known manner be transformable at least between a deflated state and an inflated. The deflated state may refer to a condition of the inflatable structure in which the inflatable structure is not pressurized, and may for instance be desirable for storage and/or transportation of the inflatable structure. Correspondingly, the inflated state may refer to a condition of the inflatable structure in which the inflatable structure is pressurized—e.g. at least up to a predetermined value, pressure and/or percentage of e.g. a maximum potential pressure to which the inflatable structure may be inflated—and which state further may be referred to as a state for intended use of the inflatable structure. The potential inflatable structure may accordingly have the ability to in an inflated state thereof be transformed into a strong, firm structure. That is, the drop stitch tethers 2 may in said inflated state hold the potential inflatable structure firmly in shape, thus allowing said inflatable structure to maintain its shape and stability under heavy outside pressure and impact. The expression "inflatable structure transformable" between a deflated and an inflated state, may refer to "inflatable structure adapted to transition and/or change" between a deflated and an inflated state. "Deflated" state, on the other hand, may refer to "unpressurized" state and/or "storage and/or transportation" state, whereas "inflated" state may refer to "pressurized" state and/or "usage and/or intended use" state. The expression "state" may refer to "condition" and/or "mode". The expression "inflatable" may refer to "pressurizable", whereas "structure" may refer to "arrangement", "article", "product" and/or "body".

FIG. 2*a* illustrates a schematic three-dimensional side view of an exemplifying alignment system 10 according to embodiments of the disclosure. The alignment system 10 is for—and/or is adapted for—aligning tethers 2 of a drop stitch fabric 1 prior to feeding the drop stitch fabric 1 to a drop stitch fabric processing machine 3. The alignment system 10 may be a standalone system and/or at least partly be integrated into the drop stitch fabric processing machine 3. The drop stitch fabric processing machine 3 is adapted for receiving the drop stitch fabric 1 for processing thereof 1. The drop stitch fabric processing machine 3 may thus refer to any—potentially known—one or more drop stitch fabric processing machines and/or systems, e.g. adapted for cutting, sewing, patching and/or welding of the drop stitch fabric 1.

Further shown in FIG. 2*a* is an exemplifying drop stitch fabric supply 4, comprising a drop stitch fabric 1 having—as shown in FIG. 1—a first layer 11 and a second layer 12 tethered by drop stitch tethers 2. The drop stitch fabric supply 4 may refer to any—potentially known—supply of drop stitch fabric 1, such as e.g. a roll and/or carrier onto and/or around which drop stitch fabric 1 beforehand has been rolled or wrapped, and/or a mere supply of drop stitch fabric 1 e.g. rolled, wrapped and/or folded, e.g. in a zigzag pattern. The drop stitch fabric supply 4 may thus have any characteristics and/or dimensions deemed suitable for storage, provision, unwinding, unrolling and/or feeding of drop stitch fabric 1, and further, a drop stitch fabric capacity of the supply 4 may e.g. range from a few tenths of metres up to hundreds of metres. The drop stitch fabric supply 4 may further for instance be provided on a rack or the like, and/or be provided within—and/or be integrated with—the drop stitch fabric processing machine 3.

"Alignment" system may refer to "directing" system and/or "offset-rectifying" system, whereas alignment system "for aligning tethers" may refer to alignment system "adapted for" aligning tethers. "Aligning" tethers, on the other hand, may refer to "directing" tethers and/or "rectifying" tethers, whereas the expression for aligning "tethers" of a drop stitch fabric may refer to for aligning "layers" of a drop stitch fabric. According to an example, the expression "for aligning tethers of a drop stitch fabric" may refer to "for aligning tethers of a drop stitch fabric to be perpendicular or essentially perpendicular to layers of the drop stitch fabric joined by the tethers". According to another example, the expression "for aligning tethers of a drop stitch fabric" may refer to "for compensating for an offset or a potential offset between layers of a drop stitch fabric". The expression "prior to" feeding the drop stitch fabric may refer to "before" feeding the drop stitch fabric, whereas "prior to feeding the drop stitch fabric" may refer to "prior to enabling the drop stitch fabric to be fed". "Drop stitch fabric" processing machine, on the other hand, may refer to "inflatable structure" processing machine, whereas drop stitch fabric "processing" machine may refer to drop stitch fabric "handling" machine. Drop stitch processing "machine" may refer to drop stitch processing "machine and/or system, whereas "a drop stitch fabric processing machine" may refer to "one or more drop stitch fabric processing machines". Furthermore, the expression drop stitch fabric "supply" may refer to drop stitch fabric "roll", "feeding roll", "carrier", and/or "magazine", and further to "feeding supply". Additionally or alternatively, drop stitch fabric "supply" may refer to drop stitch fabric "stock", "gathering" and/or" "store".

As further shown in FIG. 2*b*, which illustrates a schematic side view of a portion of FIG. 2*a*, the drop stitch fabric 1 is fed, wherein the first layer 11 is moving with a first velocity 110 and the second layer 121 is moving with a second velocity 120. According to an example, the first layer 11 may be fed and/or unwound from the drop stitch fabric supply 4 with the first velocity 110 and the second layer fed and/or unwound from the drop stitch fabric supply 4 with the second velocity 120. Thereby, a potential displacement between the layers 11, 12—and subsequently an inadequate alignment of the tethers 2—may be compensated by feeding—e.g. from a drop stitch fabric supply 4 comprising a drop stitch fabric 1—the first and second layers 11, 12 with different velocities 110, 120. That is, when e.g. coming off the drop stitch fabric supply 4, the first and the second drop stitch layers 11, 12 may—for instance due to the drop stitch fabric 1 having been rolled, wrapped and/or folded—be displaced in relation to one another in a running direction 6 of the drop stitch fabric 1, and subsequently—as illustrated on the left hand side in FIG. 2*a*—may the drop stitch tethers 2 be correspondingly inadequately aligned, such as no longer being perpendicular to the layers 11, 12. This may lead to that issues related to wrinkles and/or distortions as well as an involuntarily altered shape of a potential subsequent inflatable structure derivable from the drop stitch fabric 1, subsequently may arise. With the introduced concept, however, by feeding—e.g. from the drop stitch fabric supply 4 comprising the drop stitch fabric 1—the first layer 11 with a first velocity 110 and the second layer 12 with a potentially differing second velocity 120, a potential displacement between the layers 11, 12—and subsequently an inadequate alignment of the tethers 2—may be compensated prior to the drop stitch fabric 1 being fed to the drop stitch fabric processing machine 3, whereby said issues consequently may be avoided.

The extent of such a displacement between the layers 11, 12 and/or inadequate alignment of the tethers 2 may vary, e.g. with the extent to which the drop stitch fabric 1 e.g. may have been rolled, wrapped and/or folded prior to e.g. being fed from the drop stitch fabric supply 4. A maximum displacement is, however, essentially limited by the length 21 of the drop stitch tethers 2. The first velocity 110 may refer to any velocity deemed suitable, and may further be variable. The second velocity 120 may in a similar manner refer to any velocity deemed suitable, and may further similarly be variable. Feeding of the drop stitch fabric, e.g. physically feeding the first and the second layers 11, 12 from the drop stitch fabric supply 4, may be accomplished in any manner—e.g. known—deemed suitable, e.g. with support from one or more electrical motors (not shown). The expression "feeding" may refer to "unwinding", "supplying", "providing", "pulling", "enabling to come off", "unleashing", "unrolling" and/or "dragging", and further to "feeding in a running direction", whereas "second" velocity may refer to "differing second" velocity. "Is moving with" a first/second velocity, on the other hand, may in this context refer to "moves with" a first/second velocity, "is fed with" a first/second velocity, "has" a first/second velocity "and/or "is having" a first/second velocity.

According to an example, the phrase "feeding a drop stitch fabric having a first layer and a second layer tethered by drop stitch tethers, wherein the first layer is moving with a first velocity and the second layer is moving with a second velocity" may refer to "feeding from a drop stitch fabric supply comprising a drop stitch fabric having a first layer and a second layer tethered by drop stitch tethers, the first layer with a first velocity and the second layer with a second velocity".

Optionally, and as shown in FIG. 2*a*, there may be determined an offset 5 between the first layer 11 and the second layer 12 in the running direction 6 of the drop stitch fabric 1. Thereby, the extent by which the first and second layers 11, 12 are displaced in relation to one another, may be established. The offset 5, which may be referred to as the displacement described above, may be determined in any manner deemed suitable. For instance, the offset 5 may be estimated and/or calculated, e.g. taking into consideration the drop stitch tethers length 21. The offset 5 may furthermore additionally or alternatively be derived from detecting, determining and/or calculating e.g. a current value of a radius of the drop stitch fabric supply 4 from which value an estimated offset 5 may be derived. Optionally, however, the offset 5 may additionally or alternatively be determined with support from one or more sensors 7, such as laser sensors. Thereby, the offset 5 may be derived from detection data captured by one or more sensors 7 in a convenient manner. The one or more optional sensors 7 may refer to any—e.g. known—sensors deemed suitable for detecting the offset 5, such as optical sensors, e.g. lasers, cameras, image capturing sensors, radars and/or equivalents or successors thereof. The one or more optional sensors 7 may further be positioned anywhere deemed suitable for detection of the offset 5. The one or more sensors 7 may be adapted to detect the offset 5 between the layers 11, 12; additionally or alternatively, said sensor(s) 7 may be adapted to detect an inadequate alignment of the tethers 2, such as a deviation of said tethers 2 from being perpendicular to the layers 11, 12, from which the offset 5 may be derived. The expression "determining" an offset may refer to "determining from deriving from an inadequate alignment of the tethers" an offset, "detecting" an offset and/or "calculating based on a radius of the drop stitch fabric supply" an offset, whereas "running" direction may refer to "travel" direction and/or "longitudinal" direction. "Offset", on the other hand, may refer to "displacement" and/or "misalignment", whereas "with support from" one or more sensors may refer to "by means of" one or more sensors and/or "based on detection data derived from" one or more sensors.

Optionally, the first velocity 110 and/or the second velocity 120 may be determined based on the offset 5. Thereby, the first and/or second velocity 110, 120 may be adapted in view of the determined offset 5, whereby said determined offset 5 may be compensated. Accordingly, since a determined offset 5 at least to some extent may be compensated prior to the drop stitch fabric 1 being fed to the drop stitch fabric processing machine 3, wrinkles and/or distortions as well as an involuntarily altered shape of a potential subsequent inflatable structure derived from the drop stitch fabric 1, may to even greater extent be avoided. According to an example, the expression "wherein the first and/or the second velocity is determined based on the offset" may refer to "wherein the first and/or the second velocity is determined based on the offset such that the offset is compensated and/or at least to some extent rectified".

Further optionally, a relation between the first velocity 110 and the second velocity may be adapted to rectify the offset 5. Thereby, a relation between the first and second velocities 110, 120 may be adapted in view of the determined offset 5, whereby said determined offset 5 may be rectified. Accordingly, since a determined offset 5 may be rectified prior to the drop stitch fabric 1 being fed to the drop stitch fabric processing machine 3, wrinkles and/or distortions as well as an involuntarily altered shape of a potential subsequent inflatable structure derived from the drop stitch fabric 1, may to even greater extent be avoided. The expression "relation between the first velocity and the second velocity" may refer to "the first velocity relative the second velocity", whereas "rectify the offset" may refer to "solve the offset". According to an example, the phrase "adapted to rectify the offset" may refer to "rectifies the offset" and/or "corresponds to rectifying the offset".

Figure 2:
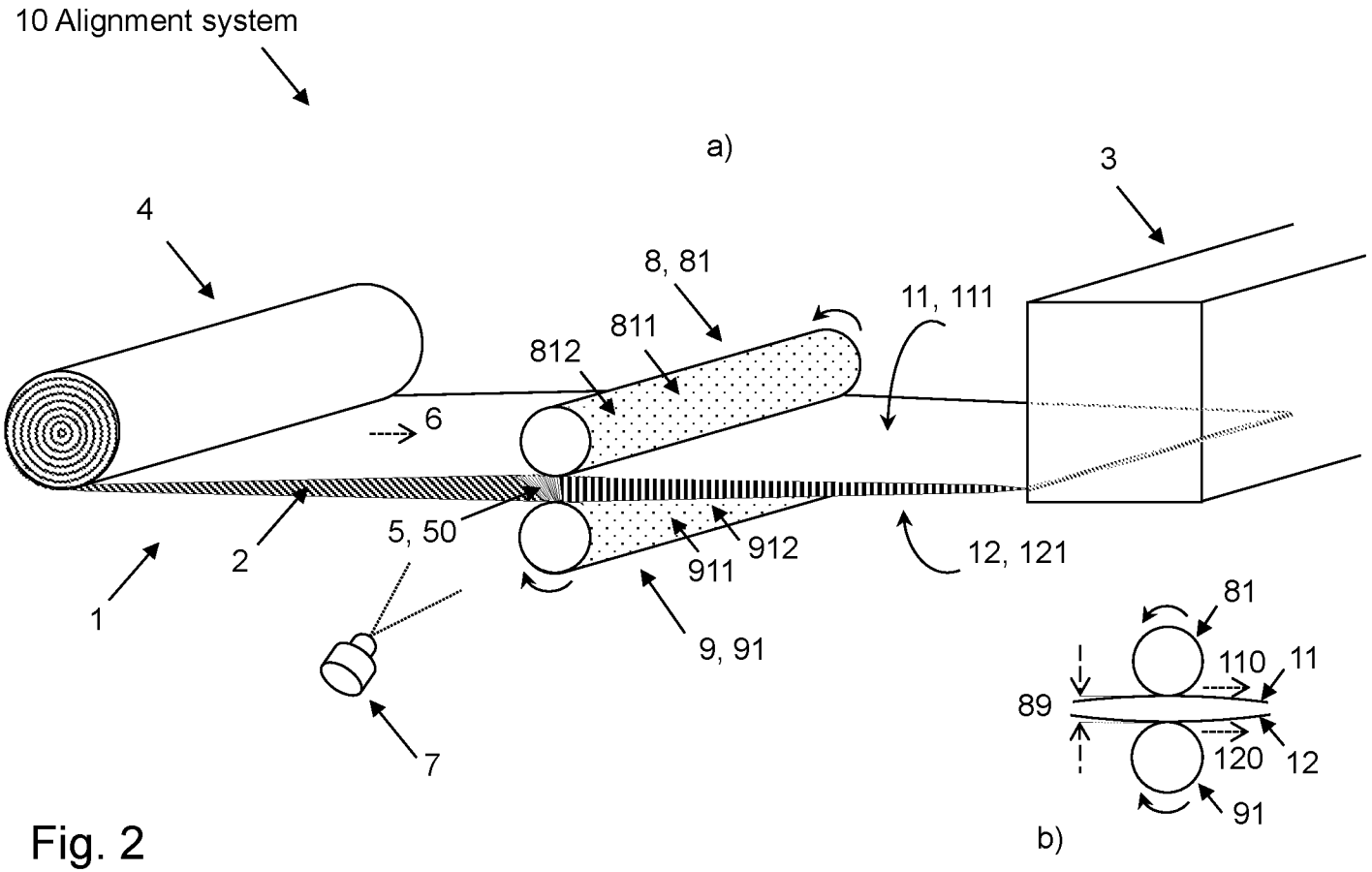
FIG. 2 illustrates schematic side views of an exemplifying alignment system according to embodiments of the disclosure.

Optionally, and as shown in FIG. 2, the first layer 11 may be fed—e.g. from the drop stitch fabric supply 4—with support from at least a first roll 8, and/or the second layer 12 may be fed—e.g. from the drop stitch fabric supply 4—with support from at least a second roll 9, an axial direction of the first 8 and/or second roll 9 being perpendicular to the running direction 6 of the drop stitch fabric 1. Thereby, the first 11 and/or second layer 12 may respectively be fed from the drop stitch fabric supply 4 with assistance from respective one or more rolls 8, 9. The drop stitch fabric 1 may, according to an example, be fed between the at least first roll 8 and the at least second roll 9. Moreover, an envelope surface 811—which may be referred to as a roll surface—of the at least first roll 8 may connect with and/or abut the outer surface 111 of the first layer 11. Correspondingly, additionally or alternatively, an envelope surface 911 of the at least second roll 9 may connect with and/or abut the outer surface 121 of the second layer 12. Thus, the at least first roll 8 and the positioning thereof may be adapted to connect with an outer surface 111 of the first layer 11, and potentially subsequently while rotating assist in feeding the first layer 11, e.g. from the drop stitch fabric supply 4. In a similar manner, the at least second roll 9 and the positioning thereof may be adapted to connect with an outer surface 121 of the second layer 12, and potentially subsequently while rotating assist in feeding the second layer 12, e.g. from the drop stitch fabric supply 4. The respective at least first and second rolls 8, 9 may be positioned as deemed suitable in the running direction 6 between the drop stitch fabric supply 4 and the drop stitch fabric processing machine 3, and moreover, a positioning of the at least first roll 8 may differ from a positioning of the at least second roll 9 in said running direction 6. In a similar manner, the at least first roll 8 and the at least second roll 9 may be positioned as deemed suitable in a direction perpendicular to the running direction 6, and moreover, a positioning of the at least first roll 8 may differ from a positioning of the at least second roll 9 in said perpendicular direction. According to an example, a proportion between a radius of the drop stitch fabric supply 4 and the positioning of the at least first roll 8 and/or the positioning of the at least second roll 9 in the running direction 6 and/or in said perpendicular direction, may be adapted and/or selected in a manner at least to some extent compensating for a potential offset 5 between the first layer 11 and the second layer 12, when the drop stitch fabric 1 is unwound, fed and/or travel by and/or between said at least first 8 and/or second roll 9.

The at least first and/or at least second roll 8, 9 may be represented by any rotatable rolls—e.g. known—adapted to assist in feeding respective first and/or second layers 11, 12, e.g. from the drop stitch fabric supply 4, directly or indirectly to the drop stitch fabric processing machine 3. Characteristics of respective at least first and/or second roll 8, 9, such as e.g. axial length, diameter, structure, friction coefficient(s), envelope surface 811, 911 and/or characteristics of said envelope surface etc., may accordingly vary with the implementation at hand. The positioning of the at least first and/or second roll 8, 9 in the running direction 6 and/or in said perpendicular direction, may further be adjustable. The expression "with support from" may in this context refer to "with assistance from", "by means of" and/or "by utilizing a feeding force and/or friction from", whereas "roll" in this context may refer to "counter roll", "rotatable roll", "feeding roll", "motor-driven roll" and/or cylinder. "Axial" direction, on the other hand, may in this context refer to "longitudinal and/or lengthwise" direction, whereas "perpendicular to" a running direction may refer to "essentially perpendicular to" a running direction. According to an example, the phrase "an axial direction of the at least first and/or second roll being perpendicular to a running direction of the drop stitch fabric" may refer to "an axial direction of the at least first and/or second roll being perpendicular to a running direction of the drop stitch fabric, the feeding comprising feeding the drop stitch fabric between the at least first roll and the at least second roll". According to another example, the phrase "an axial direction of the at least first and/or second roll being perpendicular to a running direction of the drop stitch fabric" may additionally or alternatively refer to "an axial direction of the at least first and/or second roll being perpendicular to a running direction of the drop stitch fabric, an envelope surface of the at least first roll connecting with an outer surface of the first layer and/or an envelope surface of the at least second roll connecting with an outer surface of the second layer". According to yet another example, the phrase "with support from at least a first roll" may refer to "with support from at least a first roll comprised in the alignment system", and correspondingly, the phrase "with support from at least a second roll" may refer to "with support from at least a second roll comprised in the alignment system".

Optionally, and as shown in FIG. 2, the at least first roll 8 may comprise a vacuum roll 81 and the at least second roll 9 may comprise a vacuum roll 91 positioned in parallel with the at least first vacuum roll 81 forming a gap 89 there between. The drop stitch fabric 1 may then be fed through the gap 89. Thereby, the first and/or the second layer 11, 12 may respectively be fed, e.g. from the drop stitch fabric supply 4, with assistance from respective one or more vacuum rolls 81, 91. Furthermore, since the at least first and second rolls 8, 9 respectively comprises vacuum rolls 81, 91, the first layer 11 and the second layer 12 may by the applied vacuum be pulled apart—i.e. be separated—at the gap 89, e.g. to an extent where the drop stitch tethers 2 are—or essentially are—stretched and/or tensed, which may simulate how the tethers 2 would tense during an inflated state. According to an example, the gap 89 may have a width—and/or a maximum width—between the vacuum rolls 81, 91 equal to, or essentially equal to, the drop stitch tethers length 21. Thereby, the outer surface 111 of the first layer 11 may connect with the first vacuum roll 81 and the outer surface 121 of the second layer 12 may connect with the second vacuum roll 91. Inadequate alignment of the tethers 2 may, however, result in that a thickness of the drop stitch fabric 1 falls below the tethers length 21. Thus, additionally or alternatively, the width of the gap 89 may be adjustable, e.g. such that the width of the gap may be adapted continuously and/or intermittently, for instance to adapt to a reduced thickness of the drop stitch fabric 1 which may arise from inadequately aligned tethers 2. Subsequently, the positioning of the at least first and/or second vacuum roll 81, 91 may be adjustable—e.g. continuously and/or intermittently adjustable—in the direction perpendicular to the running direction 6. Moreover, the vacuum rolls 81, 91 may be represented by any—e.g. known—vacuum rolls deemed suitable for the application at hand, and may have any feasible characteristics, e.g. in view of envelope surface 811, 911, roll diameter, vacuum level, hole geometry 812, 912 etc. The expression "vacuum roll" may refer to "suction roll", "vacuum drum" and/or "driven hollow roll with an extensive number of holes and in which vacuum is applied", whereas "positioned" in parallel may refer to "provided" and/or "located" in parallel. "In parallel", on the other hand, may refer to "in parallel in a plane perpendicular to the travel direction", whereas "feeding" the drop stitch fabric through the gap may refer to "supplying" the drop stitch fabric through the gap. The expression feeding the drop stitch "through" the gap may refer to feeding the drop stitch "between the at least first and second vacuum rolls". According to an example, the phrase "forming a gap there between" may refer to "forming a gap there between having a width equal to or essentially equal to a length of the drop stitch tethers".

Optionally, and as shown in FIG. 2, the offset 5 may be determined based on a misalignment 50 of drop stitch tethers 2 at the gap 89. Thereby, the offset 5 may be derived from learning at the gap 89—where the drop stitch tethers 2 are tensed—to what extent the drop stitch tethers 2 are inadequately aligned, such as e.g. to what extent the drop stitch tethers 2 fail to be perpendicular to the layers 11, 12. That is, by separating the layers 11, 12 with support from the vacuum rolls 81, 91 and establishing a potential misalignment 50 of the tethers 2 at the gap 89, it may thus be revealed to what extent the tethers 2—while being tensed—are inadequately aligned and subsequently correspondingly to what extent the layers 11, 12 are offset 5 in relation to one another. Should it be established that no misalignment 50 exists, then it is implied that the drop stitch tethers 2 are aligned and subsequently that no offset 5 exists between the layers 11, 12. According to an example, the misalignment 50 at the gap 89 may be detected with support from the one or more sensors 7, for instance a laser sensor. The expression "misalignment" may refer to "alignment deviation", "offset" and/or "shifting", and further to "detected misalignment" and/or "determined misalignment". "At the gap", on the other hand, may refer to "at—or in vicinity of or adjacent to—the gap" and/or "between the at least first and second vacuum rolls". According to an example, the phrase "misalignment of drop stitch tethers" may refer to "misalignment of drop stitch tethers from being perpendicular or essentially perpendicular to the layers". According to another example, the phrase "determining the offset based on a misalignment of drop stitch tethers at the gap" may refer to "determining the offset based on a misalignment of drop stitch tethers at the gap, and/or based on a deviation at the gap of a thickness of the drop stitch fabric 1 from an expected value, essentially the tethers length".

Figure 3:
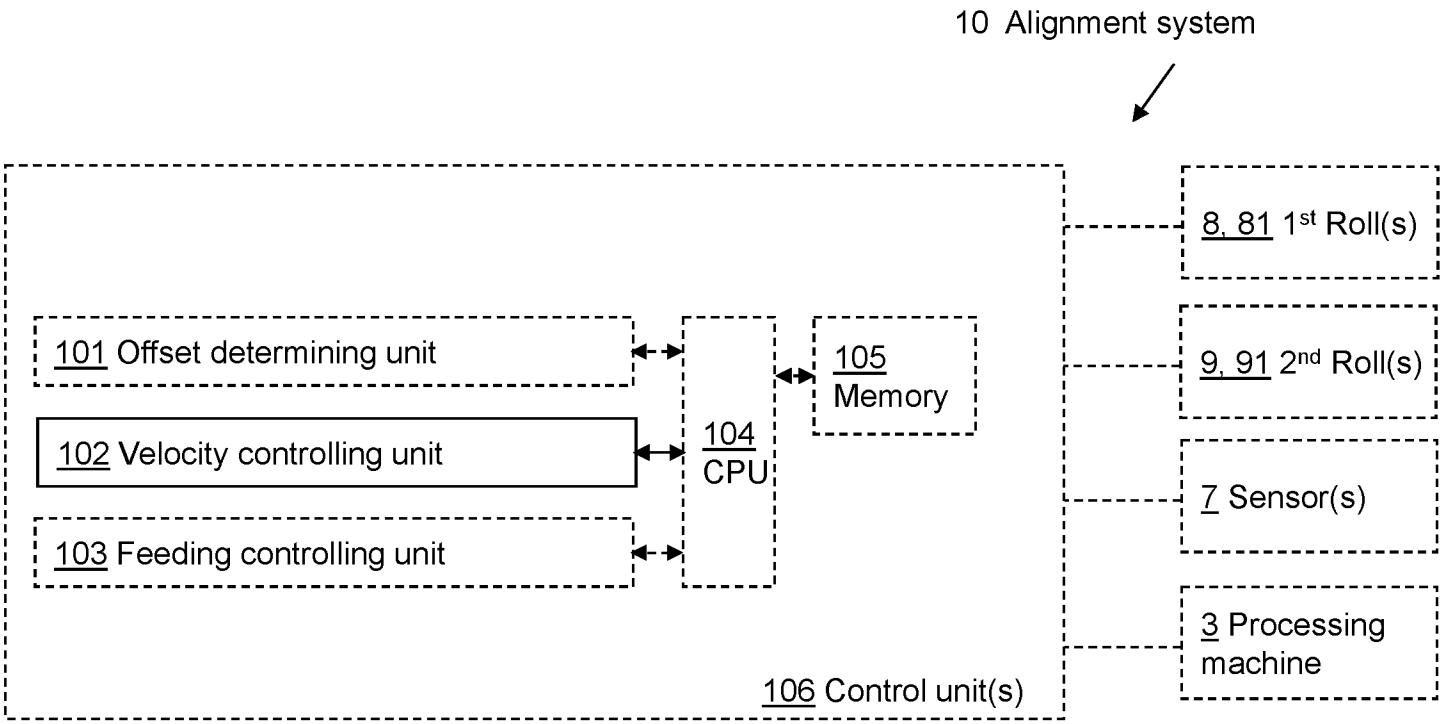
FIG. 3 is a schematic block diagram illustrating an exemplifying alignment system according to embodiments of the disclosure.
Figure 4:
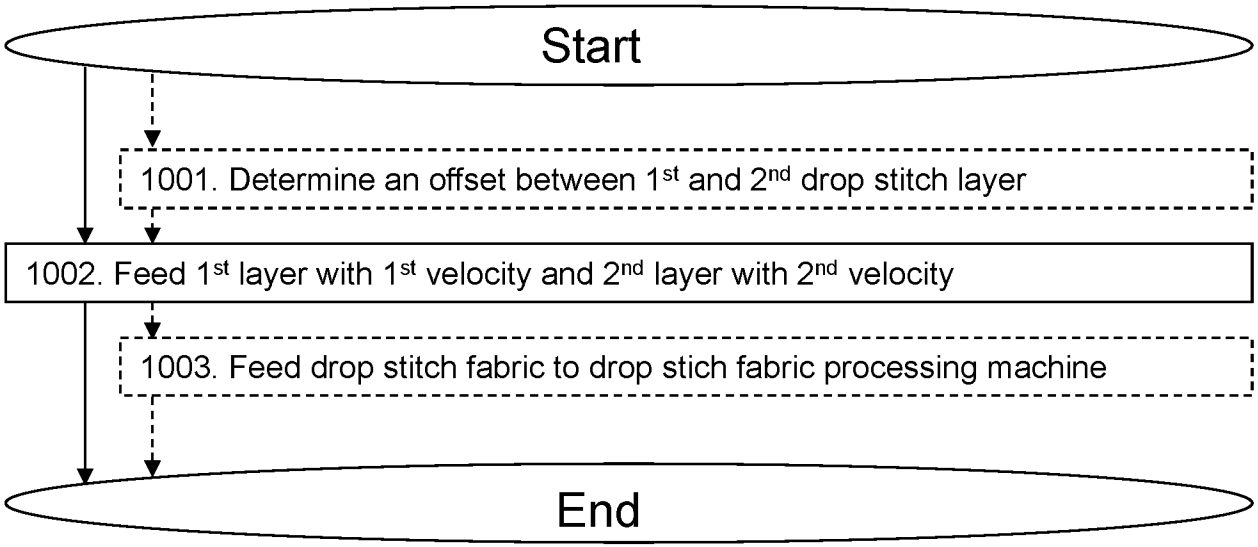
FIG. 4 is a flowchart depicting an exemplifying method according to embodiments of the disclosure, for aligning tethers of a drop stitch fabric prior to feeding the drop stitch fabric to a drop stitch fabric processing machine.

As further shown in FIG. 3, which depicts a schematic block diagram illustrating an exemplifying alignment system 10 according to embodiments of the disclosure, the alignment system 10 comprises an optional offset determining unit 101, a velocity controlling unit 102 and an optional feeding controlling unit 103, all of which will be further described in conjunction with FIG. 4. Furthermore, embodiments herein for aligning tethers 2 of a drop stitch fabric 1 prior to feeding the drop stitch fabric 1 to a drop stitch fabric processing machine 3, may be implemented through one or more processors, such as a processor 104, here denoted CPU, together with computer program code for performing the functions and actions of embodiments herein. Said program code may also be provided as a computer program product, for instance in the form of a data carrier carrying computer program code for performing the embodiments herein when being loaded into the alignment system 10. One such carrier may be in the form of a CD ROM disc or DVD. It is however feasible with other data carriers such as a memory stick. The computer program code may furthermore be provided as pure program code on a server and downloaded to the alignment system 10. The alignment system 10 may further comprise a memory 105 comprising one or more memory units. The memory 158 may be arranged to be used to store e.g. information, and further to store data, configurations, schedulings, and applications, to perform the methods herein when being executed in the alignment system 10. Furthermore, the optional offset determining unit 101, the velocity controlling unit 102, the optional feeding controlling unit 103, the optional processor 104 and/or the optional memory 105, may for instance at least partly be implemented in one or more control units 106 e.g. comprised in and/or integrated with one or more manufacturing machines such as the drop stitch fabric processing machine 3 and/or distributed among a plurality thereof. Those skilled in the art will also appreciate that said units 101, 102, 103, may refer to a combination of analog and digital circuits, and/or one or more processors configured with software and/or firmware, e.g. stored in a memory such as the memory 105, that when executed by the one or more processors such as the processor 104 perform as described herein. One or more of these processors, as well as the other digital hardware, may be included in a single ASIC (Application-Specific Integrated Circuitry), or several processors and various digital hardware may be distributed among several separate components, whether individually packaged or assembled into a SoC (System-on-a-Chip).

Further shown in FIG. 3 is the optional at least first roll 8 comprising a vacuum roll 81, the optional at least second roll 9 comprising a vacuum roll 91, the optional one or more sensors 7 and the optional drop stitch fabric processing machine 3, discussed in conjunction with FIG. 2.

FIG. 4 is a flowchart depicting an exemplifying method according to embodiments of the disclosure, for aligning tethers 2 of a drop stitch fabric 1 prior to feeding the drop stitch fabric 1 to a drop stitch fabric processing machine 3. The exemplifying method, which may be continuously repeated, comprises the following action(s) discussed with support from FIGS. 1-3. One or more actions may be performed simultaneously and/or in an alternate order.

Action 1001: In optional Action 1001, the alignment system 10 may determine an offset 5 between the first layer 11 and the second layer 12 in a running direction 6 of the drop stitch fabric 1. Correspondingly, the optional offset determining unit 101 may be adapted for determining an offset 5 between the first layer 11 and the second layer 12 in a running direction 6 of the drop stitch fabric 1.

Action 1002: In Action 1002, the alignment system 10 feeds a drop stitch fabric 1, wherein a first layer 11 is moving with a first velocity 110 and the second layer 121 is moving with a second velocity 120. Correspondingly, the velocity controlling unit 101 is adapted for controlling feeding a drop stitch fabric 1, wherein a first layer 11 is moving with a first velocity 110 and the second layer 121 is moving with a second velocity 120.

According to an example, Action 1002 may comprise the alignment system 10 feeding from a drop stitch fabric supply 4 comprising a drop stitch fabric 1 having a first layer 11 and a second layer 12 tethered by drop stitch tethers 2, the first layer 11 with a first velocity 110 and the second layer 12 with a second velocity 120. Correspondingly, according to an example, the velocity controlling unit 101 may be adapted for controlling feeding from a drop stitch fabric supply 4 comprising a drop stitch fabric 1 having a first layer 11 and a second layer 12 tethered by drop stitch tethers 2, the first layer 11 with a first velocity 110 and the second layer 12 with a second velocity 120. Thus, the phrase "a velocity controlling unit for controlling feeding a drop stitch fabric having a first layer and a second layer tethered by drop stitch tethers, wherein the first layer is moving with a first velocity and the second layer is moving with a second velocity" may according to an example refer to "a velocity controlling unit for controlling feeding from a drop stitch fabric supply comprising a drop stitch fabric having a first layer and a second layer tethered by drop stitch tethers, the first layer with a first velocity and the second layer with a second velocity".

Optionally, should Action 1002 of feeding be preceded by optional Action 1001 of determining an offset 5, then the first velocity 110 and/or the second velocity 120 may be determined based on the offset 5. Correspondingly, the velocity controlling unit 102 may optionally be adapted for determining the first velocity 110 and/or the second velocity 120 based on the offset 5. Further optionally, a relation between the first velocity 110 and the second velocity 120 may be adapted to rectify the offset 5.

Optionally, Action 1002 of feeding may comprise the alignment system 10 feeding the first layer 11 with support from at least a first roll 8 and/or feeding the second layer 12 with support from at least a second roll 9, an axial direction of the at least first and/or second roll 8, 9 being perpendicular to a running direction 6 of the drop stitch fabric 1. Correspondingly, the velocity controlling unit 102 may optionally be adapted for controlling feeding the first layer 11 with support from at least a first roll 8 and/or feeding the second layer 12 with support from at least a second roll 9, an axial direction of the at least first and/or second roll 8, 9 being perpendicular to a running direction 6 of the drop stitch fabric 1.

Further optionally, the at least first roll 8 may comprise a vacuum roll 81 and the at least second roll 9 may comprise a vacuum roll 91 positioned in parallel with the at least first vacuum roll 81 forming a gap 89 there between. Action 1002 of feeding may then comprise the alignment system 10 feeding the drop stitch fabric 1 through the gap 89. Correspondingly, the velocity controlling unit 102 may then be adapted for controlling feeding the drop stitch fabric 1 through the gap 89.

Further optionally, Action 1001 of determining an offset 5 may then comprise the alignment system 10 determining the offset 5 based on a misalignment 50 of drop stitch tethers 2 at the gap 89. Correspondingly, the optional offset determining unit 101 may be adapted for determining the offset 5 based on a misalignment 50 of drop stitch tethers 2 at the gap 89.

Action 1003: In optional Action 1003, the alignment system 10 may subsequently feed the drop stitch fabric 1 to a drop stitch fabric processing machine 3, e.g. a drop stitch fabric processing machine 3 adapted for cutting, sewing, patching and/or welding of the drop stitch fabric 1. Correspondingly, the optional feeding controlling unit 103 may be adapted for controlling subsequently feeding the drop stitch fabric 1 to a drop stitch fabric processing machine 3, e.g. a drop stitch fabric processing machine 3 adapted for cutting, sewing, patching and/or welding of the drop stitch fabric 1.

The person skilled in the art realizes that the present disclosure by no means is limited to the preferred embodiments described above. On the contrary, many modifications and variations are possible within the scope of the appended claims. It should furthermore be noted that the drawings not necessarily are to scale and the dimensions of certain features may have been exaggerated for the sake of clarity. Emphasis is instead placed upon illustrating the principle of the embodiments herein. Additionally, in the claims, the word "comprising" does not exclude other elements or steps, and the indefinite article "a" or "an" does not exclude a plurality.

Various examples have been described. These and other examples are within the scope of the following claims.

The invention claimed is:

1. A method performed by an alignment system for aligning tethers of a drop stitch fabric prior to feeding the drop stitch fabric to a drop stitch fabric processing machine, the method comprising:

feeding a drop stitch fabric having a first layer and a second layer tethered by drop stitch tethers, wherein the first layer is moving with a first velocity and the second layer is moving with a second velocity; and first determining an offset between the first layer and the second layer in a running direction of the drop stitch fabric.

2. The method according to claim 1, wherein the first velocity and/or the second velocity is determined based on the offset.

3. The method according to claim 2, wherein a relation between the first velocity and the second velocity is adapted to rectify the offset.

4. The method according to claim 1, wherein the feeding comprises feeding the first layer with support from at least a first roll and/or feeding the second layer with support from at least a second roll, an axial direction of the at least first and/or second roll being perpendicular to a running direction of the drop stitch fabric.

5. The method according to claim 4, wherein the at least first roll comprises a vacuum roll and the at least second roll comprises a vacuum roll positioned in parallel with the at least first vacuum roll forming a gap there between, the feeding comprising feeding the drop stitch fabric through the gap.

6. The method according to claim 5, wherein the determining the offset comprises determining the offset based on a misalignment of drop stitch tethers at the gap.

7. A computer program product comprising a computer program containing computer program code means arranged to cause a computer or a processor to execute the steps of a method according to claim 1, stored on a computer-readable medium or a carrier wave.

8. The method according to claim 1, further comprising:

subsequently feeding the drop stitch fabric to a drop stitch fabric processing machine adapted for cutting, sewing, patching and/or welding of the drop stitch fabric.

9. The method according to claim 1, wherein the determining the offset comprises determining the offset with support from one or more sensors.

10. An alignment system for aligning tethers of a drop stitch fabric prior to feeding the drop stitch fabric to a drop stitch fabric processing machine, the alignment system comprising:

a velocity controlling unit for controlling feeding a drop stitch fabric having a first layer and a second layer tethered by drop stitch tethers, wherein the first layer is moving with a first velocity and the second layer is moving with a second velocity; and an offset determining unit for first determining an offset between the first layer and the second layer in a running direction of the drop stitch fabric.

11. The alignment system according to claim 10, wherein the velocity controlling unit is adapted for determining the first velocity and/or the second velocity based on the offset.

12. The alignment system according to claim 11, wherein a relation between the first velocity and the second velocity is adapted to rectify the offset.

13. The alignment system according to claim 10, wherein the velocity controlling unit is adapted for controlling feeding the first layer with support from at least a first roll and/or controlling feeding the second layer with support from at least a second roll, an axial direction of the at least first and/or second roll being perpendicular to a running direction of the drop stitch fabric.

14. The alignment system according to claim 13, wherein the at least first roll comprises a vacuum roll and the at least second roll comprises a vacuum roll positioned in parallel with the at least first vacuum roll forming a gap there between, the velocity controlling unit being adapted for controlling feeding the drop stitch fabric through the gap.

15. The alignment system according to claim 14, wherein the offset determining unit is adapted for determining the offset based on a misalignment of drop stitch tethers at the gap.

16. The alignment system according to claim 10, further comprising:

a feeding controlling unit for controlling subsequently feeding the drop stitch fabric to a drop stitch fabric processing machine adapted for cutting, sewing, patching and/or welding of the drop stitch fabric.

17. The alignment system according to claim 10, wherein the offset determining unit is adapted for determining the offset with support from one or more sensors.

18. A drop stitch fabric processing machine comprising the alignment system according to claim 10.

* * * * *